United States Patent [19]

Nagase

[11] 4,102,004

[45] Jul. 25, 1978

[54] DOOR CLOSER

[75] Inventor: Toshiro Nagase, Sagamihara, Japan

[73] Assignee: Tokico Ltd., Kanagawa, Japan

[21] Appl. No.: 766,504

[22] Filed: Feb. 7, 1977

[30] Foreign Application Priority Data

Feb. 16, 1976 [JP] Japan ..... 51-16937[U]

[51] Int. Cl.[2] ..... E05F 3/00

[52] U.S. Cl. ..... 16/49; 16/82

[58] Field of Search ..... 16/49, 51, 58, 66, 71, 16/82, 84; 49/137

[56] References Cited

U.S. PATENT DOCUMENTS 2,881,467 4/1959 Struhar ..... 16/66

3,042,957 7/1962 Mussel et al. ..... 16/49 X 3,156,002 11/1964 Schmid ..... 16/49

*Primary Examiner*—Ronald Feldbaum

*Attorney, Agent, or Firm*—Wenderoth, Lind & Ponack

[57] ABSTRACT

A device for controlling the opening or closing speed of a door includes a piston-piston rod assembly slidably fitted in the inner tube of a dual tube hydraulic cylinder. Oil is enclosed in the inner tube and in a portion of the outer tube, and a high pressure gas is enclosed in the outer tube for affording a force on the assembly to project the piston rod outwardly of the cylinder. A mechanism controls oil flow in the cylinder when the piston moves in one direction in the cylinder. A device converts the reciprocal movement of the piston rod into opening-closing movement of the door.

5 Claims, 4 Drawing Figures

DOOR CLOSER

BACKGROUND OF THE INVENTION

This invention relates to a door closer or a device for controlling the opening or closing movement of a door and, particularly, to a door closer with a simplified construction and a minimized size.

One prior art door closer comprises, for example, a casing forming an outer body of the door closer, a buffer device or drive means disposed in the casing and including a piston-piston rod assembly slidably fitted in a cylinder containing hydraulic oil therein and a check valve or the like disposed in the piston for generating hydraulic resisting force when the piston moves in one direction, a generally U-shaped actuating plate with rack teeth formed therein and secured to the extreme end of the piston rod which projects outside of the buffer device, the actuating plate being bent at the mid-portion thereof such that a portion of the plate extends in a direction away from the buffer device, a pinion meshingly engaging with the rack teeth and rotatable in association with the opening-closing movement of the door, and a metal spring interposed between the actuating plate and the casing.

The door closer having the construction described above has a substantial length in the direction of the axis of the door closer. Thus, space for mounting the door closer is very large and the construction of the door closer is complicated.

SUMMARY OF THE INVENTION

The present invention provides a door closer which can eliminate the aforementioned shortcomings and can afford a simplified construction and a reduced axial length by omitting the metal spring and utilizing a high pressure gas enclosed in the buffer device.

BRIEF DESCRIPTION OF THE DRAWINGS

Two embodiments of the present invention will be explained hereinafter in conjunction with the accompanying drawings, in which.

DETAILED DESCRIPTION OF THE INVENTION

Figure 1:
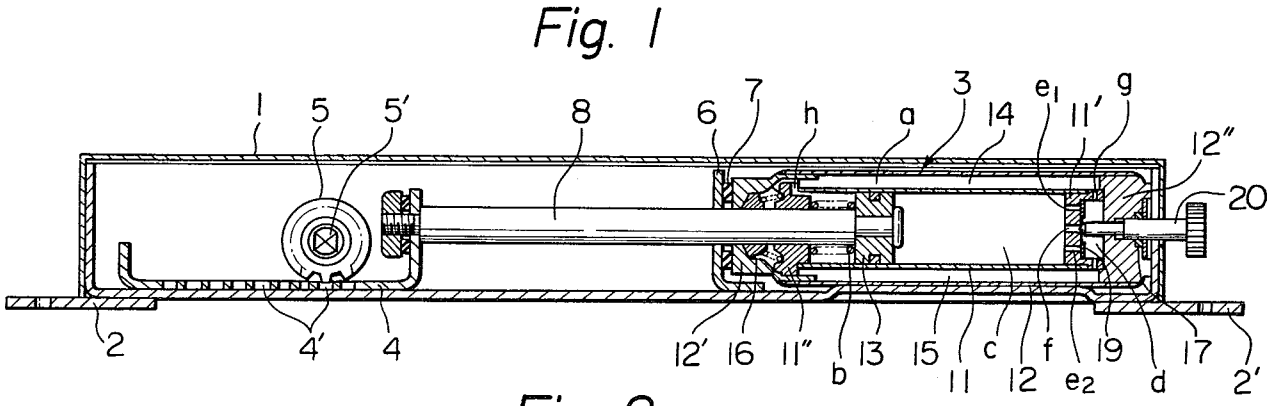
FIG. 1 is a cross-sectional view of a door closer exemplifying the present invention.
Figure 2:
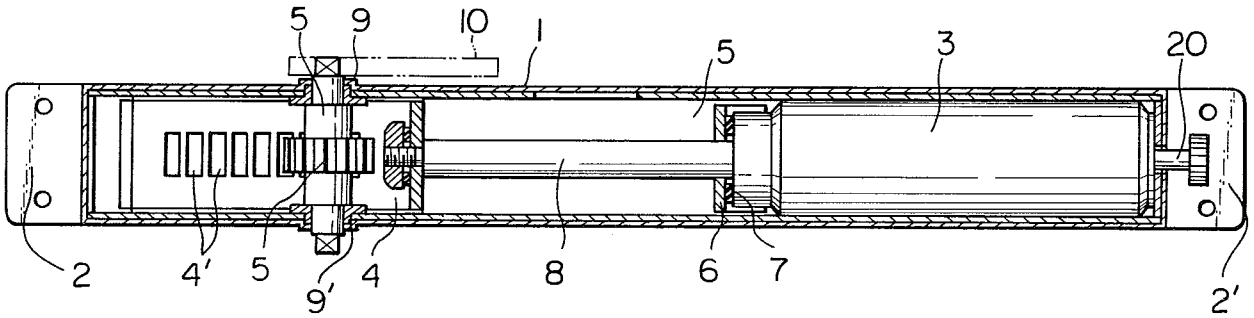
FIG. 2 is a partial cross-sectional view of the door closer of FIG. 1 as viewed in the direction perpendicular to FIG. 1.

The door closer shown in FIGS. 1 and 2 comprises a casing 1 having mounting brackets 2, 2' secured integrally thereto for mounting the door closer to a door (not shown), an actuating plate 4 secured to one end of a piston rod 8 of a buffer device or drive means 3, and a pinion 5 meshingly engaging with rack teeth 4' of the actuating plate 4. The drive means 3 is disposed in the casing 1 and mounted on a mounting plate 6 secured to the casing 1 through a thin resilient member 7 such as rubber or the like. The piston rod 8 projects reciprocably from one end of the drive means 3. One end of the actuating plate 4 is secured to the extreme end or an end projecting outside of the drive means 3 of the piston rod 8. The actuating plate 4 is bent in a direction away from the drive means 3 so as to extend in a direction generally parallel to the axis of the drive means 3, and the rack teeth 4' are formed in the extending portion of the plate 4. The actuating plate 4 reciprocates with the reciprocation of the piston rod 8 to rotate the pinion 5 meshingly engaging with the rack teeth 4' of the actuating plate 4. A shaft 5' of the pinion 5 is journaled through bearings 9, 9' on the casing 1, and one end (or both ends) thereof projects outside of the casing 1 and is connected to an actuating arm 10 for transmitting actuating force on the door.

The drive means 3 comprises a dual tube container consisting of an inner tube 11 and an outer tube 12, and the inner tube 11 has slidably positioned therein a piston 13 secured to the other end of the piston rod 8, and oil is enclosed in the inner tube 11. An annular chamber defined between the inner tube 11 and the outer tube 12 receives oil 15 and high pressure gas 14. The high pressure gas 14 maintains a high pressure prevailing in the container which generates an axial force on the piston 13 according to the difference in pressure receiving areas on the opposite sides of the piston 13 to generate a door closing or opening force, and also compensates for the change in volume of the interior space of the container when the piston 13 with the piston rod 8 slidably moves in the inner tube 11, thereby retracting or projecting the rod 8 into or from the container.

To generate a door opening or closing force of the door closer, it is required to communicate the annular chamber *a* formed between the inner tube 11 and the outer tube 12 with at least one of two chambers *b* and *c* which are separated from one another by the piston 13 in the interior of the inner tube 11. In this embodiment, both chambers *b,c* are communicated with the chamber *a*. For this end, an annular recessed chamber *d* is formed in one end of an end plug 11' for communicating with the chamber *c* through an oil passage *f* and with chamber *a* through an oil passage *g*, and an oil passage *h* is formed in an end plug 11'' to communicate the chamber *a* with the chamber *b*. Chambers *a*, *b* and *c* may be connected in three ways, namely, connecting the chambers *a* and *b* and also connecting the chambers *b* and *c* through a hole extending through the piston 13, connecting the chambers *a* and *b* and also connecting the chambers *b* and *c*, and connecting the chambers *a* and *b* and also connecting the chambers *a* and *c*. In the embodiment of FIG. 1, the last mentioned manner is depicted. Packings 16, 17 are fitted in end plugs 12', 12'' closing opposite ends of the outer tube 12 seal the high pressure gas 14 and the oil 15. Another seal is fitted on the outer periphery of the piston 13 for separating the chamber *b* from the chamber *c*. The end plugs 12', 12'' are welded to the outer tube 12.

Figure 3:
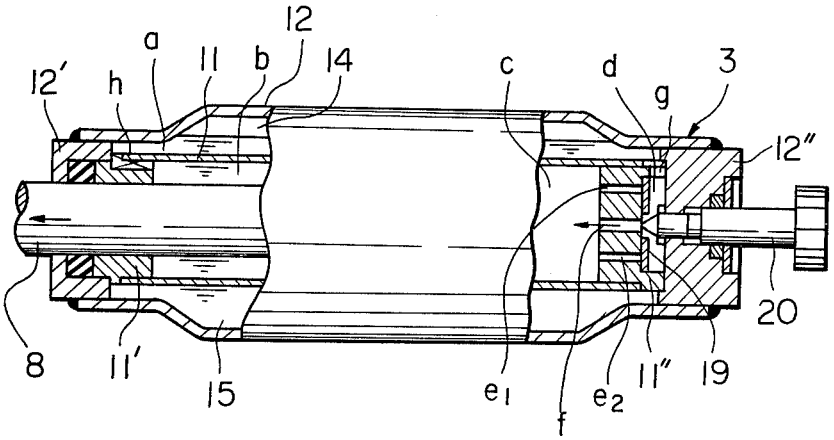
FIG. 3 is a cross-sectional view of the essential portion of a modified door closer and showing a condition when the piston is moving in one direction.

FIG. 3 shows a modified form in which the opposite end portions of the outer tube 12 of drive means 3 are formed to have reduced diameters as compared with the central portion thereof. Since the remaining portion of the door closer is of a construction similar to that of FIG. 1, further detailed description will be omitted and corresponding numerals will be applied to corresponding parts. Since the opposite ends of the outer tube 12 are formed to have reduced diameters, the high pressure gas 14 will not act directly on the welded portions between the outer tube 12, and end plugs 12', 12'' thus preventing gas leakage.

Additionally, the drive means 3 is provided with a buffer mechanism or a mechanism controlling the door closing speed. To attain the sliding movement of the piston 13 in the inner tube 11, the two chambers *b, c* partitioned by the piston 13 are communicated so that oil in the two chambers can move correspondingly. The door closing speed can be controlled by providing for controlling resistance of oil flow in the drive means 3.

Figure 4:
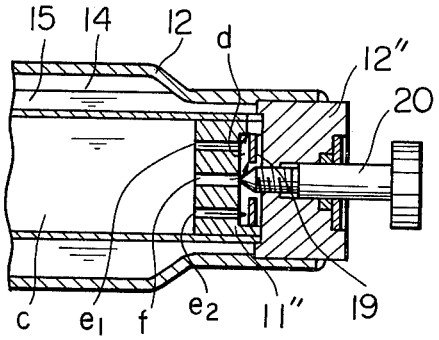
FIG. 4 is a partial cross-sectional view of the door closer of FIG. 3 to show a condition when the piston is moving in the opposite direction.

The two chambers *b, c* partitioned by the piston 13 can be communicated by providing an oil passage between the chamber *a* and the chamber *b* and an oil passage between the chamber *a* and the chamber *c*, and these oil passages may serve as well as the oil passages formed between the inner and outer tubes for attaining a spring force. In the embodiment shown in FIG. 1, oil passages *h, g* and *f* are formed between the chambers *a* and *b* and between the chambers *a* and *c* and also act as oil passages for generating the spring force. For affording a resistance to the oil flow through these oil passages in closing the door, there is provided the oil passage *f*, and, for reducing the resistance of oil flow when opening the door, further oil passages $e_1$, $e_2$ . . . are provided in the end plug 11" to connect the chambers *c* and *d*. The oil passages $e_1$, $e_2$ . . . are disposed parallel with the oil passage *f* and cooperate with a check valve member 19 which is slidably provided in the chamber *d* and is guided by the inner periphery of the recess. Thus, the oil passages $e_1$, $e_2$ . . . will open only when the piston 13 moves in the door opening direction as shown in FIG. 4 so as to enable the oil to flow freely from the chamber *c* to the chamber *d*, and when the piston 13 moves in the door closing direction as shown in FIG. 3 the oil passages $e_1$, $e_2$ . . . will close thereby generating a resistance to the oil flow which is then only through the oil passage *f*. It will be noted that similar oil passages with a resistance generating mechanism may alternately be provided in the piston 13 or another part of the drive means.

In the embodiments shown in the drawings, a pin 20 is mounted on the end plug 12", slidably or screw-threadingly rotatably therein, with one end thereof opposing an opening of the oil passage *f* and the other end thereof projecting outside of the casing 1, whereby the opening area of the oil passage *f* can be changed thus controlling the resistance of oil flow through the passage *f*. Such controlling can easily be effected from the outside of the door closer.

A door closer having the construction described above does not have any metal spring between the actuating plate 4 and the casing 1 as is the case with prior art door closers, thus making it possible to omit the length portion which has been required for incorporating the metal spring, and thus the overall length of the door closer can be reduced. Further, since the member for supporting the metal spring can be omitted, the construction of the door closer can be simplified.

The function of the door closer will now be described. When the door opens from the closed condition (FIG. 1), the door opening force will be transmitted through the actuating arm 10 to rotate the pinion 5 in the door opening direction, thereby moving the rack 4' rightwardly as viewed in FIG. 1 through the meshing engagement between the rack 4' and the pinion 5 and, accordingly, the rod 8 and the piston 13 move rightwardly.

In the drive means 3, oil in the chamber *c* in the inner tube 11 flows through the oil passage *f* and through oil passages $e_1$, $e_2$ . . . by opening the check valve body 19 as shown in FIG. 4 without producing substancial resistance to the oil flowing between the chambers *c* and *d*. Thus the door can be opened without producing large resistance. At that time the volume of the high pressure gas 14 in the drive means 3 decreases by the amount of the volume of the rod 8 which has moved into the drive means 3, and the high pressure gas 14 is compressed to increase the pressure prevailing in the drive means 3, thereby increasing the force urging the piston 13 in the leftward direction, whereby a door closing force is stored in the drive means 3.

In closing the door, the door is moved by the pressure of the high pressure gas 14, and the rod 8 moves leftwardly as viewed in FIG. 1. When the piston 13 moves in this direction, oil in the chamber *b* in the inner tube 11 flows into the chamber *a* through the passage *h*, and oil in the chamber *a* flows into the chamber *d* through the passage *g*, and through the passage *f* into the chamber *c*. Oil passages $e_1$, $e_2$ . . . are closed by the check valve body 19, thus, oil flow from the chamber *d* to chamber *c* through the passages $e_1$, $e_2$ . . . is prevented. A hydraulic resisting force is produced when the oil flows only through the oil passage *f*, which thus reduces the closing speed of the door. By adjusting the passage area of the passage *f* by the pin 20, the closing speed of the door can be adjusted. Since the actuating portion of the pin 20 projects outside of the casing 1 of the door closer, the adjustment can be effected without disassembling the door closer or without changing various parts of the door closer. The leftward movement of the rod 8 moves the actuating plate 4 correspondingly, thus, the pinion 5 rotates in the door closing direction by the engagement between the rack 4' and the pinion 5, and the actuating arm 10 moves the door in closing direction so that the door is closed.

The door closer according to the present invention has the following advantages as compared with prior art door closers.

(a) The overall axial length can be reduced since no metal spring acting on the actuating plate is included.

(b) The high pressure gas enclosed in the drive means acts as a source of the driving force, thus, it is possible to substantially reduce the manufacturing cost since the many parts which have been incorporated to mount the metal spring can be omitted.

(c) By reducing the diameter of the opposite end portions of the outer tube, it is possible to prevent leakage of the high pressure gas, thereby improving operation reliability of the door closer.

(d) By extending the device for adjusting the door closing speed outside of the casing the closing speed can be easily adjusted by hand.

What is claimed is:

1. A door closer or a device for controlling the opening or closing speed of a door, said device comprising:

a casing;

a dual tube hydraulic cylinder positioned within said casing, said cylinder including an inner tube located within an outer tube and fixedly positioned with respect thereto, there being an annular chamber defined between said inner and outer tubes;

a piston slidably positioned within said inner tube;

a piston rod extending through a first end of said cylinder, said piston rod having a first end fixed to said piston;

an actuating plate attached to a second end of said piston rod, said actuating plate having rack teeth thereon;

a pinion positioned in said casing in engagement with said rack teeth, said pinion adapted to be operatively connected to a door;

hydraulic oil enclosed within said inner tube and a portion of said annular chamber;

means for allowing said oil to flow between the interior of said inner tube and said annular chamber upon movement of said piston within said inner tube;

the remaining portion of said annular chamber being filled with a pressurized gas, such that movement of said piston in a first direction within said inner tube causes hydraulic oil to flow from the interior of said inner tube into said annular chamber and to compress said pressurized gas, the thus compressed pressurized gas thereby acting as means for forcing hydraulic oil from said annular chamber into the interior of said inner tube and for forcing said piston to move in a second direction within said inner tube; and means, extending from the exterior of said cylinder through a second end thereof, for controlling the amount of hydraulic oil flow between said inner tube and said annular chamber.

2. A device as claimed in claim 1, wherein opposite end portions of said outer tube are of reduced diameter size.

3. A device as claimed in claim 1, wherein said piston partitions the interior of said inner tube into first and second chambers which are in communication with each other only through passages formed in opposite end portions of said inner tube and through said annular chamber.

4. A device as claimed in claim 3, wherein said oil flow controlling means comprises a pin adjustably disposed in said second end of said cylinder, said pin having an inner end cooperating with the said passage extending through the adjacent end portion of said inner tube.

5. A device as claimed in claim 1, wherein said actuating plate comprises a substantially L-shaped member having a leg portion extending in a direction away from said cylinder, said leg portion being guided within said casing by an inner wall thereof.

* * * * *